United States Patent [19]

Auclair et al.

[11] 4,021,033

[45] May 3, 1977

[54] SKATING AID

[76] Inventors: Roland G. Auclair, 339 West St., High Park, Mass. 02136; Roland A. Auclair, 1514 Beacon St., Brookline, Mass. 02146

[22] Filed: May 27, 1975

[21] Appl. No.: 580,668

[52] U.S. Cl. ..... 272/70.3

[51] Int. Cl.[2] ..... A63C 3/04

[58] Field of Search ..... 272/70.3, 70, 70.4; 128/83.5, 80 R, 80 G, 83, 87, 68, 82, 84 R; 248/1, 27, 132, 146–151; 280/23, 26, 200, 11.37 R, 87.02 W

[56] References Cited

UNITED STATES PATENTS

| | | | |
|---|---|---|---|
| 2,278,901 | 4/1942 | Smock | 272/70.4 |
| 2,565,257 | 8/1951 | Nichol | 272/70.3 |
| 2,732,004 | 1/1956 | Forbes | 272/70.4 |
| 3,235,254 | 2/1966 | Fobson | 272/70.3 |
| 3,350,095 | 10/1967 | Clasen | 272/70.3 |

FOREIGN PATENTS OR APPLICATIONS

| | | | |
|---|---|---|---|
| 172,785 | 6/1906 | Germany | 272/70.4 |
| 321,317 | 4/1957 | Switzerland | 272/70.4 |

*Primary Examiner*—Richard C. Pinkham
*Assistant Examiner*—T. Brown
*Attorney, Agent, or Firm*—Wolf, Greenfield & Sacks

[57] ABSTRACT

A mobile skating aid for providing support for a beginning skater includes a lower frame disposed immediately above the ground surface and having wheels or low friction discs to facilitate mobility. A U-shaped hand rail is supported by posts which extend upwardly from the lower frame. The posts are arranged to enable the height of the hand rail to be adjusted and further are capable of being collapsed easily and in a manner which permits the entire device to be stored in a substantially flat, convenient configuration.

5 Claims, 7 Drawing Figures

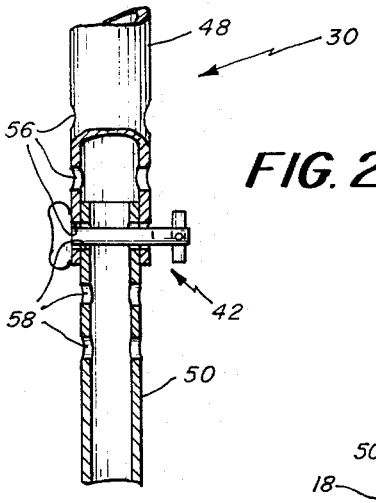
FIG. 2
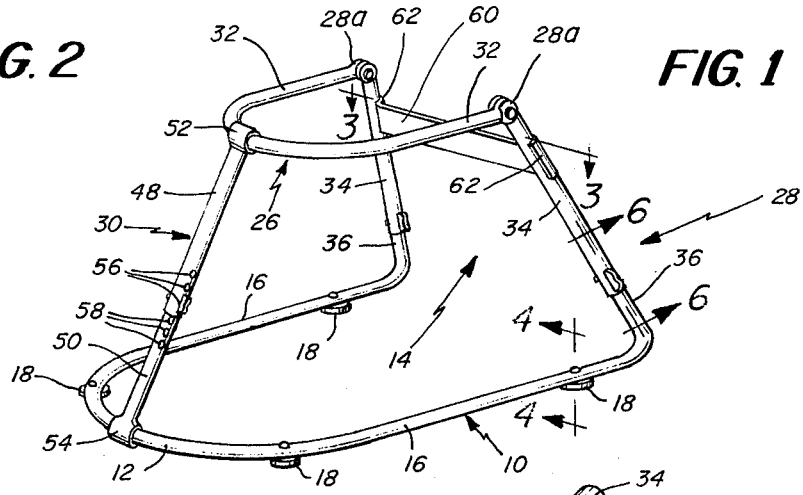
FIG. 1
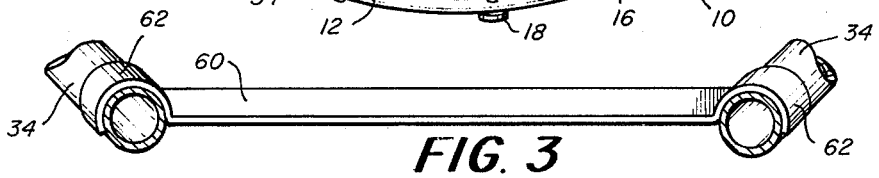
FIG. 3
FIG. 4
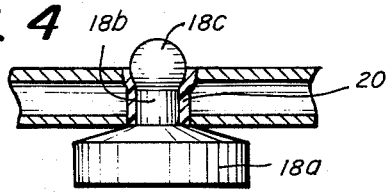
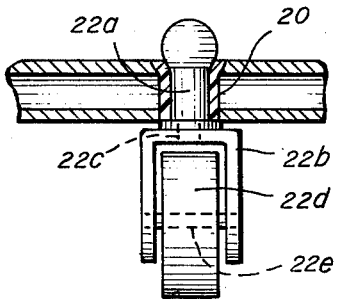
FIG. 5
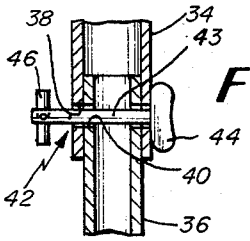
FIG. 6
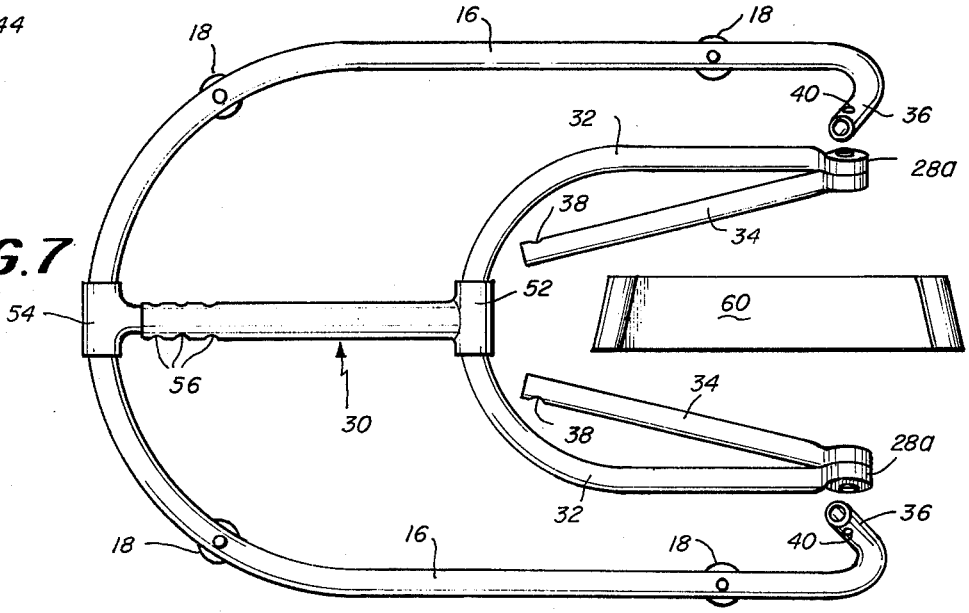
FIG. 7

SKATING AID

BACKGROUND AND SUMMARY OF THE INVENTION

This invention relates to improvements in skating aids or the like usable to provide support for ice skating or roller skating beginners. While a number of such mobile skating aids have been proposed in the prior art, those devices have a number of disadvantages. For example, they do not enable the user to skate in the natural skating position, and they tend to restrict and confine the skater in a manner which impairs the learning process. Furthermore, most of them are expensive to manufacture and difficult to store and assemble. In addition, many of them either lack adjusting means to accomodate users of different height, or if they are adjustable, the adjustments are difficult to make and require special hand tools.

It is particularly desirable that the device be of simple construction and that it be foldable or collapsible into a flat, compact configuration to facilitate transporting it to and from the skating site as well as for general storage. It is also most desirable that the skating aid be capable of easy height adjustment so that it may be used by skaters of various ages and sizes.

In brief, the invention includes an enlarged U-shaped lower frame having wheels or low friction glides attached thereto to enable it to move freely over the skating surface. The upper end of the device includes a hand rail which is also of generally U-shaped configuration, open at its rear. The rear ends of the U-shaped hand rail are pivoted to downwardly extending posts which are connected to upwardly extending support posts in turn connected to the ends of lower frame. The forward end of the U-shaped hand rail is supported by a telescopically adjustable front post which also is connected to the front end of the lower frame. The upper end of the front post is pivotally connected to the front end of the hand rail, and the lower end of the front post is pivotally mounted on the lower frame. The height of the hand rail can be adjusted easily and quickly merely by varying the length of the front post.

It is among the objects of the invention to provide an improved mobile skating aid which provides substantial support for a beginner without unduly restricting his freedom of movement and without requiring him to assume awkward positions which interfere with the learning process.

Another object of the invention is to provide an improved skating aid of the type described which is easily adjusted for use by skaters of different ages and sizes.

A further object of the invention is to provide a skating aid of the type described which is of light weight, inexpensive and simple construction.

A further object of the invention is to provide a skating aid of the type described which is easy to enter and exit.

DESCRIPTION OF THE DRAWINGS

A foregoing and other objects and advantages of the invention will be understood more fully from the following detailed description thereof, with reference to the accompanying drawings wherein:

FIG. 1 is a perspective view of a skating aid constructed in accordance with this invention.

FIG. 2 is an enlarged detail view of the adjustable front post of the aid.

FIG. 3 is a cross sectional view taken along section lines 3—3 of FIG. 1.

FIG. 4 is an enlarged fragmentary cross sectional view taken along the section line 4—4 of FIG. 1.

FIG. 5 is an enlarged fragmentary cross sectional view similar to FIG. 4 but showing a roller on the frame.

FIG. 6 is an enlarged fragmentary cross sectional view taken along section line 6—6 of FIG. 1.

FIG. 7 is a plan view of the skating aid in the collapsed condition.

DESCRIPTION OF THE PREFERRED EMBODIMENT

As shown in the drawings, the invention includes a lower U-shaped main frame 10 having a front end 12, open rear end 14 and side members 16. The frame 10 is provided with skids 18 in the form of plastic pop-in discs that enable it to slide with little frictional resistance. The discs may be replaced with rollers 22 as shown in FIG. 5. One skid 18 is shown in detail in FIG. 4. It includes a lower horizontal disc **18*a* and stem 18*b*. The stem has an enlarged head 18*c* which snap fits into the socket 20 provided in frame 10. The sockets are also used to support the rollers as shown in FIG. 5. The rollers are casted so that they may move in any direction. Each roller includes a stem 22*a* which is received in socket 20 in the frame, a bracket 22*b* pivoted by pin 22*c* on the bottom of stem 22*a*, and a wheel 22*d* carried by its shaft 22*e* on the bracket. When the device is to be used as a roller skating aid, rollers may be preferred in place of the skids 18.** The surface will, of course, dictate which is preferable.

An upper hand rail indicated generally by the reference character 26 is supported above the lower frame 10 by a pair of rear support posts 28 and a telescopically adjustable front post 30. The hand rail 26 is of generally U-shaped configuration having a bight at its forward end and a pair of rearwardly extending side portions 32.

The rear ends **28*a* of the side portions 32 of hand rail 26 are permanently pivotally connected to posts 34. The posts 34 are tubular and telescopically receive the upwardly extending supports 36 which are formed as an integral part of the lower U-shaped frame 10. The posts and supports 34 and 36 interlock by means of the aligned openings 38 and 40 in the posts and supports, respectively, and locking pins 42 as shown in detail in FIG. 6. The locking pins 42 are conventional, having a shaft 43, rigid head 44 and pivotally supported cross pin 46. Merely by aligning the cross pin 46 with the shaft 43 the locking pin may be inserted in or withdrawn from the openings 38 and 40** to permit locking or separation of the posts and supports.

The front post 30 is composed of two sections 48 and 50. The upper section 48 is pivotally supported at the bight of the hand rail 26 by means of the collar 52 formed at its upper end, and the lower end of post section 50 is similarly provided with a collar 54 that surrounds the front 12 of the lower frame 10.

The upper section 48 as indicated, telescopically receives the lower section 50, and each is provided with the plurality of holes 56 and 58 respectively that may be selectively connected by means of the pin 42 as shown in FIG. 2. The plurality of holes in the two sections 48 and 50 obviously allow the length of the post 30 to be varied. In this manner, the height of the forward portion of the hand rail 26 may be varied so that the skating aid may accomodate users of different height.

The assembly is completed by a bar member 60 which is designed to be removably mounted on the two rear posts 34 as shown in FIGS. 1 and 3. The bar 60 is provided with semicylindrical end collars 62 that have a circumferential extent of somewhat more than 180°. Consequenty, the bar 60 may be snapped onto the posts 28 by slightly spreading the collars. Obviously the bar 60 may be mounted on and removed from the posts without great difficulty.

From the foregoing description, it will be recognized that the height adjustment of the skating aid is primarily supplied by the adjustable front post 30. Regardless of the size of the user, the height of the back of the aid remains the same.

It will be appreciated that the unit may be readily collapsed merely by pulling the locking pins 42 which interconnect the posts 34 and supports 36. (It may be convenient but not necessary to unsnap the bar 60 as well.) When the two pins are pulled, the pivotal connections at the rear of hand rail 26 as well as the pivotal connections at the top and bottom of front post 30, enable the entire assembly to be collapsed substantially into a single plane, with the exception of the short supports 36. That is, the collar 54 permits the post 30 to be placed in a horizontal position parallel to the sides 16 of lower frame 10, and collar 52 permits the handle 26 to be oriented in the same plane. In addition, the posts 34 may be folded in a forward direction generally parallel to the sides 16 of the lower frame. This collapsed condition is shown in FIG. 7. And to adjust the skating aid, it is only necessary to pull the pin 42 which interconnects the telescoped sections of the front post 30, and align any of the opening 56 and 58.

Because the bar 60 may be removed and remounted so readily, it may be convenient for the user to remove the bar when he enters and leaves the skating aid. While the bar 60 is not an essential element in the skating aid, it does lend rigidity to the system.

The device may be made from lightweight tubular material such as aluminum, or alternatively it may be made from extruded plastic tubing. It is only necessary that the device have sufficient rigidity and strength to withstand the normal weight and forces to which such devices are subjected.

It should be understood, that the foregoing description of the invention is intended merely to be illustrative thereof and that other embodiments and modifications may be made of the aid without departing from the spirit of this invention.

Having thus described the invention, what I desire to claim and secure by Letters Patent is:

1. A skating training aid comprising a generally U-shaped, horizontally disposed lower frame member, a generally U-shaped upper frame member, said upper frame member being attached to said lower frame substantially parallel and spaced therefrom, the open end portion of said frame members being a rearward portion of said training aid and the bight portion of said frame members being a forward portion of the training aid, said upper frame member serving as a hand rail for a user of the training aid, a forward post pivotally connected to both the front of the upper frame member and to the front of the lower frame member, a pair of rear posts connecting the rearward portion of the side members of the upper frame member to the rearward portion of the lower frame member, and means for moving the rear posts relative to the upper and lower frame members whereby the upper and lower frame members may be collapsed into a common plane by virtue of their pivotal connections with the forward post.

2. A device as described in claim 1 further characterized by said forward post being composed of two telescoping sections, a plurality of openings formed in the sections which may be selectively aligned with one another for varying the length of the forward post, and a pin cooperating with the openings for releasably securing the two sections together at any selected length.

3. A device as defined in claim 2 wherein the rearward portion of said lower frame member is turned upwardly and telescopically connected to the lower end of said rear posts; and means for releasably connecting the rear posts to said upwardly turned portion.

4. A device as defined in claim 3 further characterized by a plurality of skids means releasably mounting said skids on said lower frame member.

5. A device as defined in claim 4 further characterized by a bar releasably mounted on and extending between the rear posts.

* * * * *